US010815981B2

(12) United States Patent
Wu

(10) Patent No.: US 10,815,981 B2
(45) Date of Patent: Oct. 27, 2020

(54) VARIABLE PRESSURE AIR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 131 days.

(21) Appl. No.: 16/103,986

(22) Filed: Aug. 16, 2018

(65) Prior Publication Data

US 2020/0056601 A1 Feb. 20, 2020

(51) Int. Cl.

| | |
|---|---|
| ***F04B 33/00*** | (2006.01) |
| ***F04B 39/10*** | (2006.01) |
| ***F04B 27/14*** | (2006.01) |
| ***F04B 27/00*** | (2006.01) |
| ***F04B 39/00*** | (2006.01) |
| ***F04B 25/02*** | (2006.01) |

(52) U.S. Cl.

CPC ..... *F04B 33/005* (2013.01); *F04B 25/02* (2013.01); *F04B 27/005* (2013.01); *F04B 27/14* (2013.01); *F04B 39/0016* (2013.01); *F04B 39/10* (2013.01)

(58) Field of Classification Search

CPC .... F04B 27/005; F04B 27/0891; F04B 27/14; F04B 33/005; F04B 39/0016; F04B 39/10; F04B 25/02; F04B 25/005; F04B 33/00; F04B 39/14; F04B 49/007; F04B 49/02

USPC ..... 417/545, 554

See application file for complete search history.

(56) References Cited

U.S. PATENT DOCUMENTS

| | | | | |
|---|---|---|---|---|
| 5,443,370 A * | 8/1995 | Wang | F04B 33/005 | 417/238 |
| 6,027,316 A * | 2/2000 | Wang | F04B 25/02 | 137/538 |
| 6,065,947 A * | 5/2000 | Wu | F04B 25/02 | 417/526 |
| 6,135,733 A * | 10/2000 | Wu | F04B 33/005 | 417/467 |
| 6,371,741 B1 * | 4/2002 | Wu | F04B 19/02 | 417/446 |
| 8,944,782 B2 * | 2/2015 | Chuang | F04B 33/00 | 417/238 |

FOREIGN PATENT DOCUMENTS

| | | |
|---|---|---|
| TW | 228257 | 8/1994 |

* cited by examiner

*Primary Examiner* — Patrick Hamo
*Assistant Examiner* — Joseph S. Herrmann
(74) *Attorney, Agent, or Firm* — Alan D. Kamrath; Karin L. Williams; Mayer & Williams PC

(57) ABSTRACT

A variable pressure air pump includes a first cylinder and a second cylinder movable relative to the first cylinder along a longitudinal axis. An air tube is mounted in the first and second cylinders. A mounting portion is integrally formed on a first end of the air tube. A first piston and a second piston compress air in the first and second cylinders. A connecting device is mounted to the first cylinder for coupling with an object to be inflated. An air escape device selectively seals a second chamber of the second cylinder to selectively compress the air in the second cylinder. A first check valve is mounted to the mounting portion of the air tube. A second check valve is mounted to the second piston.

9 Claims, 5 Drawing Sheets

VARIABLE PRESSURE AIR PUMP

BACKGROUND OF THE INVENTION

The present invention relates to a variable pressure air pump and, more particularly, to a variable pressure air pump that can be assembled rapidly.

Improvement to current air pumps focuses on the inflating efficiency. However, improvement in both of the inflating efficiency and the inflating effect could not be attained due to the fact that the cross sectional area of the cylinder is inverse proportional to the pressure. To attain switching of an air pump between a high volume output and a high pressure output, Taiwan Patent Publication No. 228257 discloses an air pump providing a selection between rapid inflation and high pressure inflation. The air pump includes a first cylinder and a second cylinder both of which provide a rapid inflating effect when operate simultaneously. The second cylinder can be locked to the first cylinder to increase the inflating pressure. However, the above air pump requires complicated assembling procedures and a high manufacturing cost.

BRIEF SUMMARY OF THE INVENTION

The present invention provides a variable pressure air pump that can be rapidly assembled and that permits high pressure inflation or high volume inflation.

A variable pressure air pump according to the present invention includes a first cylinder having a first chamber. A second cylinder includes a second chamber selectively intercommunicating with an outside. The second cylinder and the first cylinder are coaxially mounted about a longitudinal axis. The second cylinder is movable relative to the first cylinder along the longitudinal axis. An air tube is mounted in the first chamber and the second chamber. The air tube includes a first end, a second end opposite to the first end, an air passage intercommunicating the first chamber with the second chamber in a single direction, and a mounting portion integrally formed on the first end of the air tube. A first piston is mounted on a first end of the second cylinder and is configured to compress air in the first chamber. A second piston is mounted to the second end of the air tube and is configured to selectively compress air in the second chamber. A connecting device is mounted to a first end of the first cylinder and is configured to couple with an object to be inflated. An air escape device is mounted to a second end of the second cylinder. The air escape device selectively seals the second chamber to control intercommunication between the second chamber and the outside. A first check valve is mounted to the mounting portion of the air tube and is configured to permit compressed air in the first chamber to flow through the air passage and the connecting device and into the object to be inflated in a single direction. A second check valve is mounted to the second piston and is configured to permit compressed air in the second chamber to flow into the air passage in a single direction.

In an example, the mounting portion includes a first annular groove, a second annular groove, and a third annular groove. The first, second, and third annular grooves are defined in a circumferential direction of the mounting portion and are parallel to each other. The first check valve includes a first check member mounted in the first annular groove, a first airtight ring mounted in the second annular groove, and a second airtight ring mounted in the third annular groove.

In an example, the first check member is made of a soft material and is annular. The first check member has increasing outer diameter towards the connecting device along the longitudinal axis.

In an example, the second piston includes a through-hole extending between the second chamber and the air passage. The second check valve includes a second check member movably received in the through-hole and a third airtight ring mounted on an outer periphery of the second piston.

In an example, the second check member is in the form of a ball.

In an example, the air escape device includes a connecting member and a switching member. The connecting member is connected to the second cylinder and includes at least one relief hole intercommunicating with the second chamber. The switching member is connected to the connecting member and is switchable between a first position and a second position. The switching member includes at least one air guiding groove selectively intercommunicating the at least one relief hole and the outside. The switching member further includes at least one sealing portion selectively seals the at least one relief hole. When the switching member is in the first position, the at least one air guiding groove intercommunicates with the at least one relief hole, and the second chamber intercommunicates with the outside. When the switching member is in the second position, the at least one sealing portion seals the at least one relief hole, and the second chamber is isolated from the outside.

In an example, the switching member is annular and rotatably mounted around the connecting member. The at least one guiding groove and the at least one sealing portion are disposed on an inner periphery of the switching member. At least one high pressure indicator is disposed on an outer periphery of the switching member and is located corresponding to the at least one air guiding groove. At least one high volume indicator is disposed on the outer periphery of the switching member and is located corresponding to the at least one sealing portion.

In an example, the connecting device includes a head and a valve unit mounted in the head. The head is connected to the first end of the first cylinder. The valve unit intercommunicates with the air passage.

In an example, a handle is pivotably mounted to the connecting member by a pin.

In an example, the first cylinder includes a cap having an air replenishment hole intercommunicating with the first chamber.

The present invention will become clearer in light of the following detailed description of illustrative embodiments of this invention described in connection with the drawings.

DETAILED DESCRIPTION OF THE INVENTION

Figure 1:
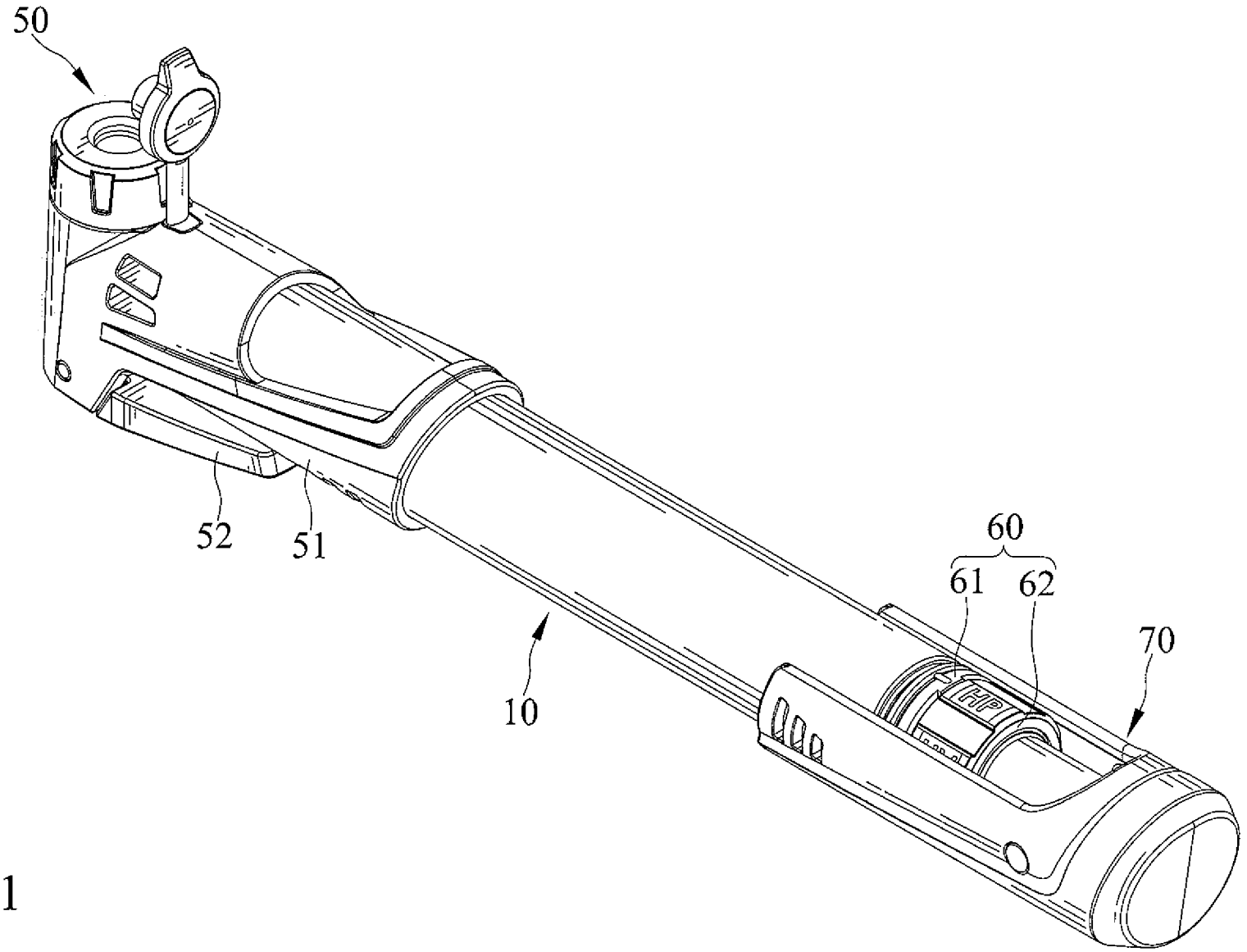
FIG. 1 is a perspective view of a variable pressure air pump of an embodiment according to the present invention.
Figure 2:
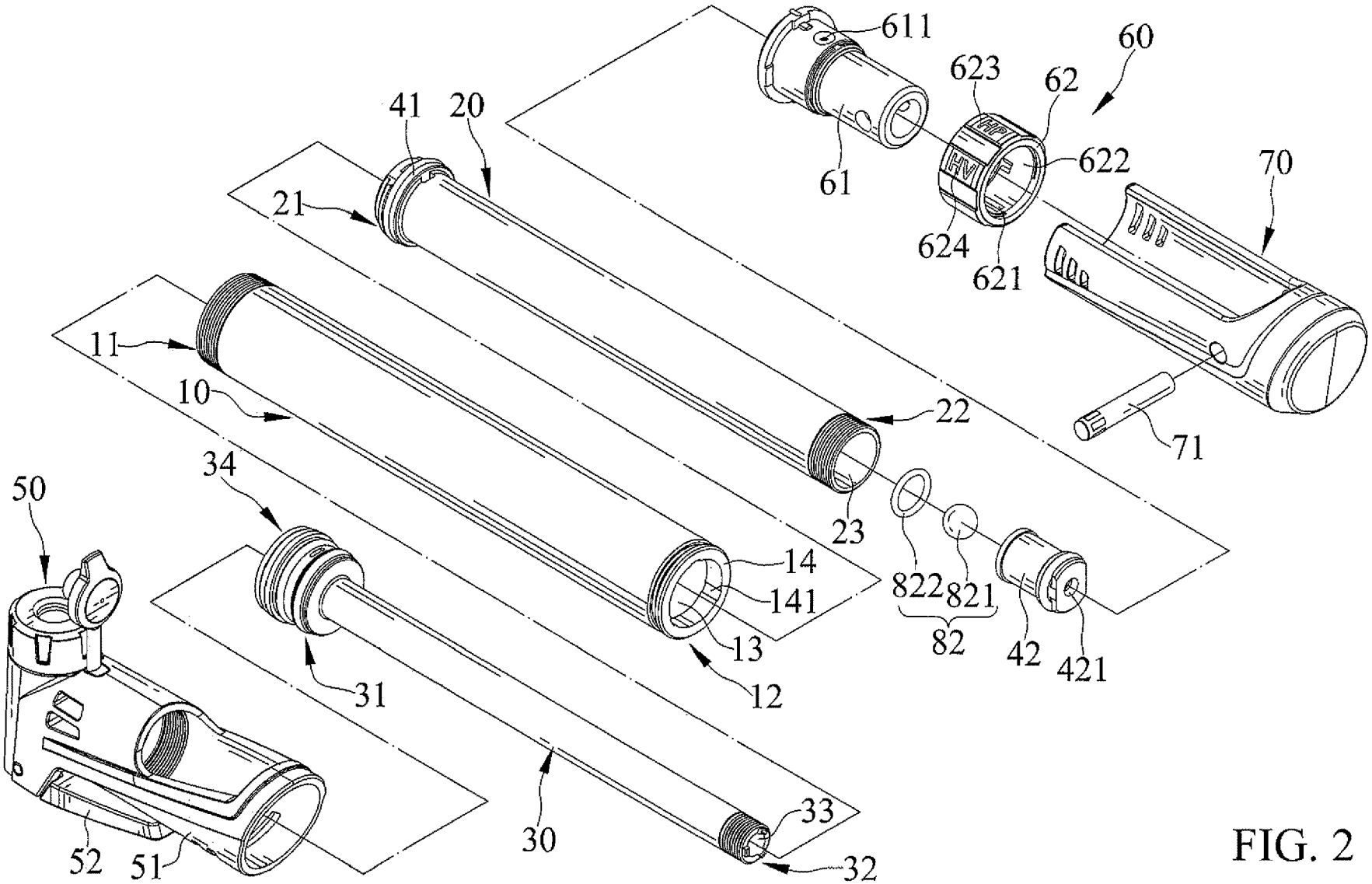
FIG. 2 is an exploded, perspective view of the variable pressure air pump of FIG. 1.
Figure 3:
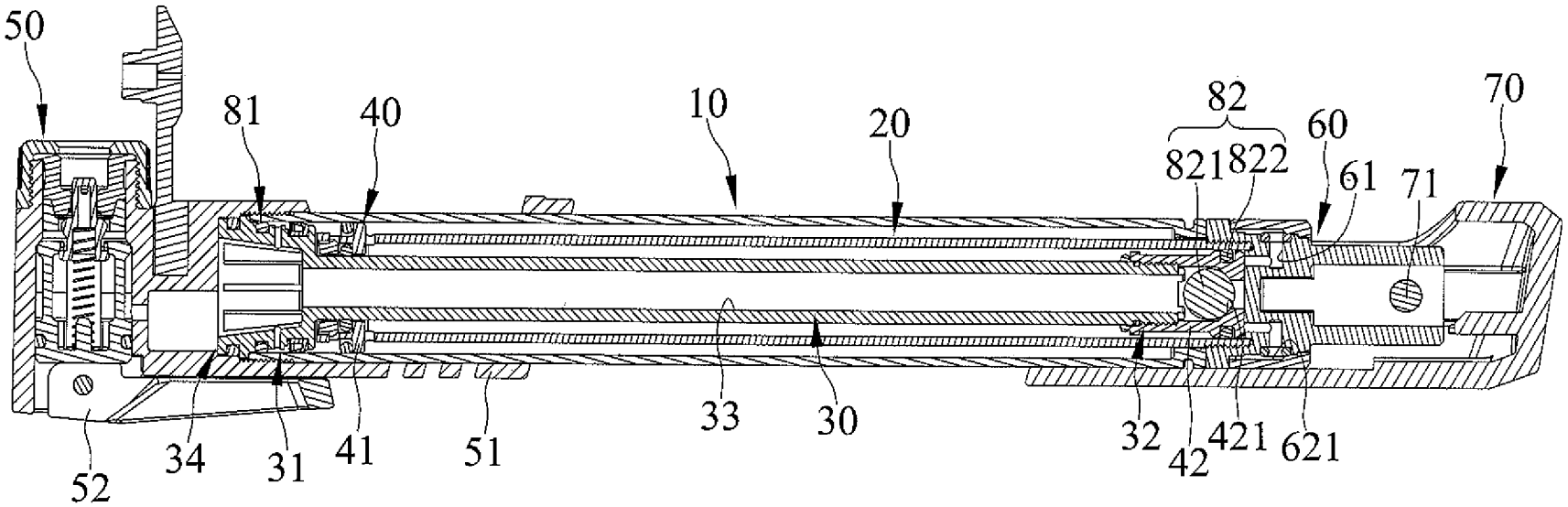
FIG. 3 is a cross sectional view of the variable pressure air pump of FIG. 1.
Figure 4:
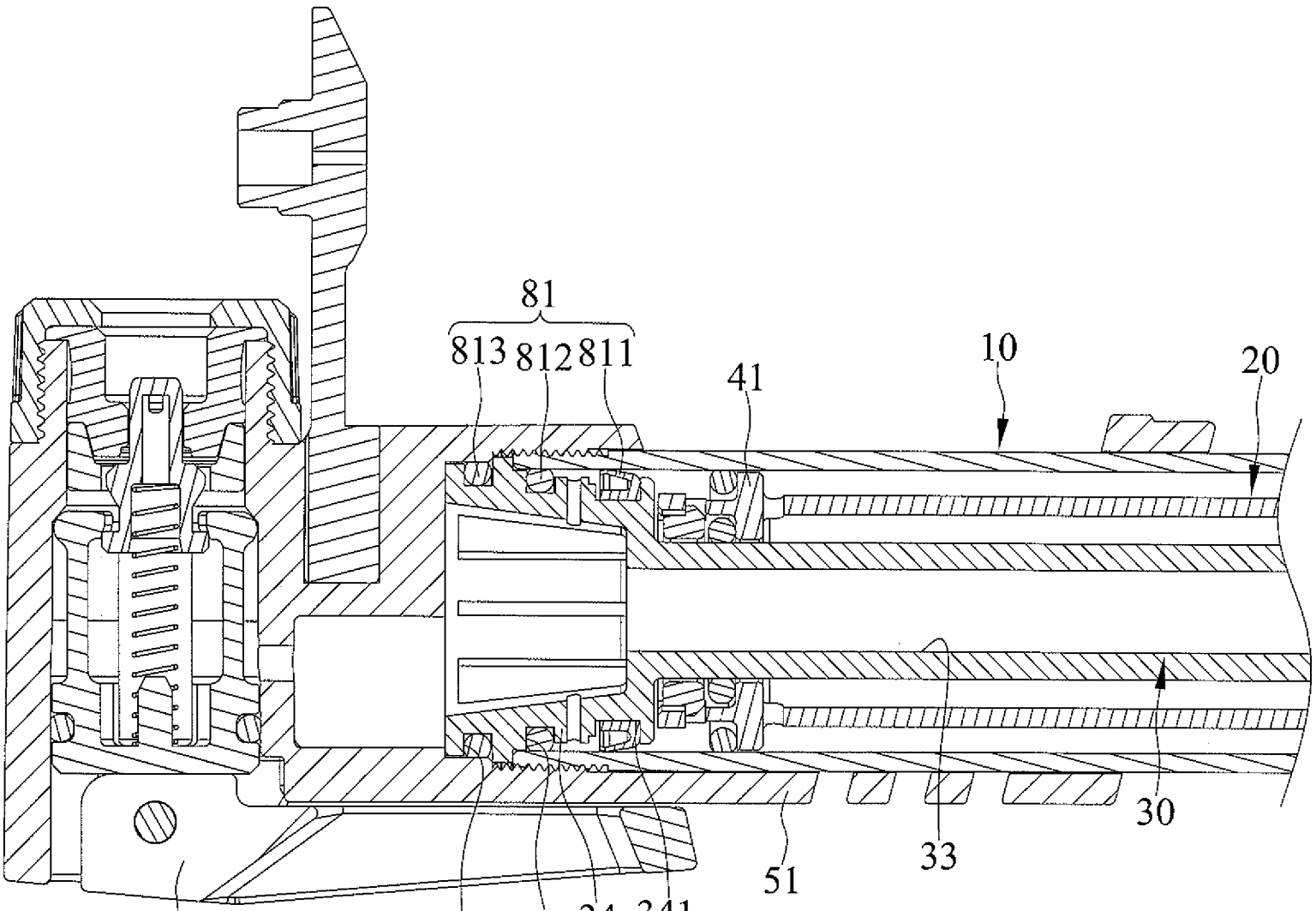
FIG. 4 is an enlarged view of a portion of the variable pressure air pump of FIG. 3.

With reference to FIGS. 1-5, a variable pressure air pump of an embodiment according to the present invention according to the present invention includes a first cylinder 10, a second cylinder 20, an air tube 30, a piston unit 40, a connecting device 50, an air escape device 60, a handle 70, and a check valve device 80. Second cylinder 20 and first cylinder 10 are coaxially mounted about a longitudinal axis. Second cylinder 20 is movable relative to first cylinder 10 along the longitudinal axis. Air tube 30 is coaxially mounted in first cylinder 10 and second cylinder 20. Piston assembly 40 can compress air in first cylinder 10 and second cylinder 20 in response to movement of second cylinder 20 relative to first cylinder 10. Connecting device 50 is mounted to first cylinder 10 and is configured to couple with an object to be inflated. Air escape device 60 selectively seals second cylinder 20 to control intercommunication between second cylinder 20 and the outside. Handle 70 is pivotably mounted to air escape device 60 and can be gripped by a user. Check valve device 80 is mounted in first cylinder 10 and second cylinder 20, such that compressed air can only enter air tube 30 in a single direction. Air escape device 60 selective intercommunicates second cylinder 20 with the outside, such that work is selectively done on the air in second cylinder 20 by piston unit 40 to provide a variable pressure while providing a high pressure inflating pattern or a high volume inflating pattern.

The first cylinder 10 includes a first end 11, a second end 12 opposite to first end 11, and a first chamber 13 extending from first end 11 through second end 12. A cap 14 is mounted to second end 12 of first cylinder 10 and has an air replenishment hole 141 intercommunicating with first chamber 13. Air replenishment hole 141 is defined in an inner periphery of cap 14.

Second cylinder 20 includes a first end 21, a second end 22 opposite to the first end 21, and a second chamber 23 extending from first end 21 through second end 22 and selectively intercommunicating with the outside.

Air tube 30 is mounted in first chamber 13 and second chamber 23. Air tube 30 includes a first end 31, a second end 32 opposite to the first end 31, an air passage 33 extending from first end 31 through second end 32 and intercommunicating the first chamber 13 with the second chamber 23 in a single direction, and a mounting portion 34 integrally formed on the first end 11 of the air tube 30. In this embodiment, the mounting portion 34 includes a first annular groove 341, a second annular groove 342, and a third annular groove 343. First, second, and third annular grooves 341, 342, 343 are defined in a circumferential direction of mounting portion 34 and are parallel to each other.

Figure 5:
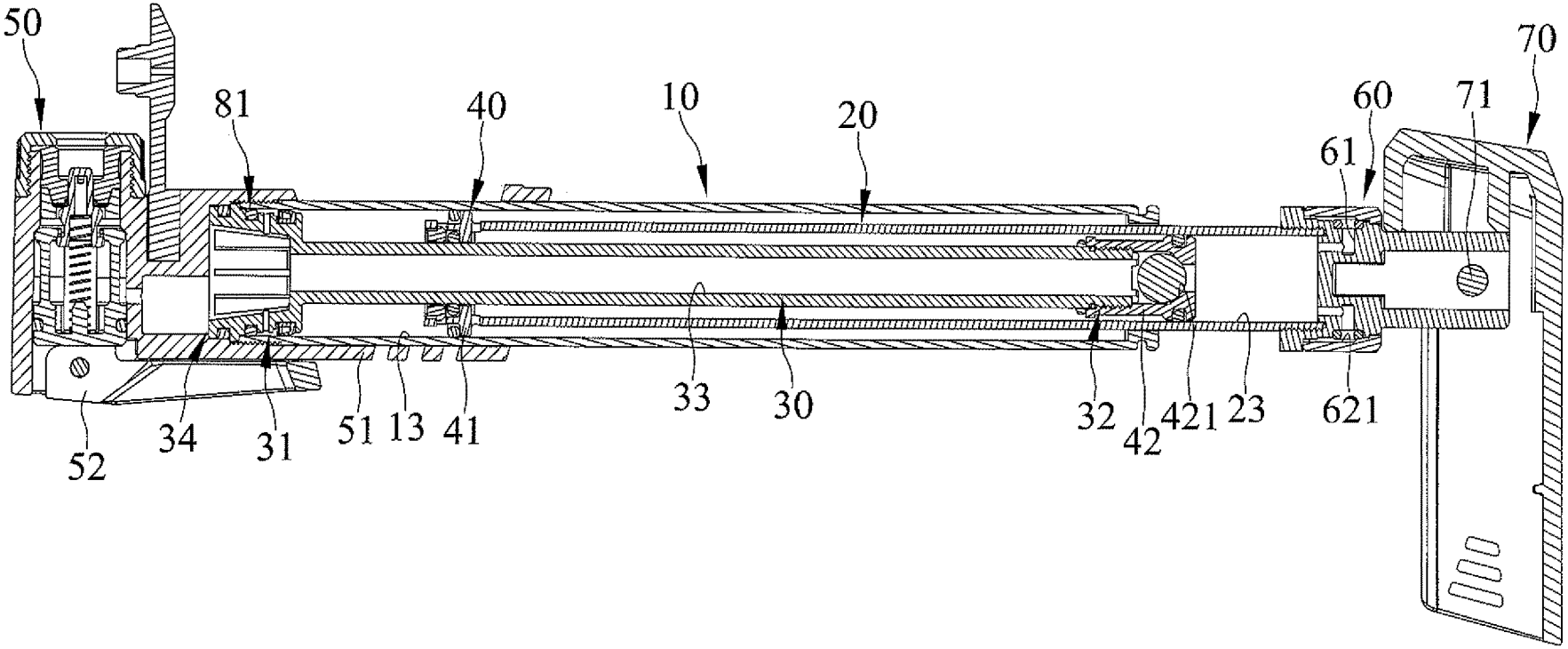
FIG. 5 is a cross sectional view illustrating operation of the variable pressure air pump of FIG. 1.

Piston unit 40 includes a first piston 41 and a second piston 42. As shown in FIG. 5, first piston 41 is mounted on first end 21 of second cylinder 20 and around air tube 30. First piston 41 is movable relative to first chamber 13 along the longitudinal axis to compress air in first chamber 13. Second piston 42 is mounted to second end 32 of air tube 30 and is movable relative to second chamber 23 along the longitudinal axis in response to movement of second cylinder 20 relative to first cylinder 10 to thereby selectively compress air in the second chamber 23. Second piston 42 includes a through-hole 421 extending between second chamber 23 and air passage 33.

Connecting device 50 includes a head 51 and a valve unit 52 mounted in head 51. Head 51 is connected to first end 11 of first cylinder 10 and first end 31 of air tube 30. Valve unit 52 intercommunicates with air passage 33 and is configured to couple with a valve of the object to be inflated.

Air escape device 60 includes a connecting member 61 and a switching member 62. Connecting member 61 is connected to second cylinder 20 and includes at least one relief hole 611 intercommunicating with second chamber 23. Switching member 62 is connected to connecting member 61 and is switchable between a first position and a second position. Switching member 62 includes at least one air guiding groove 621 selectively intercommunicating the at least one relief hole 611 and the outside. Furthermore, switching member 62 includes at least one sealing portion 622 selectively seals the at least one relief hole 611. In this embodiment, connecting member 61 includes two diametrically disposed relief holes 611.

In this embodiment, switching member 62 is annular and rotatably mounted around connecting member 61. Thus, switching member 62 is rotatable relative to connecting member 61 between the first position and the second position. The at least one guiding groove 621 and the at least one sealing portion 622 are disposed on an inner periphery of switching member 62. At least one high pressure indicator 623 is disposed on an outer periphery of switching member 62 and is located corresponding to the at least one air guiding groove 621. At least one high volume indicator 624 is disposed on the outer periphery of switching member 62 and is located corresponding to the at least one sealing portion 622. Switching member 62 can include two air guiding grooves 621 respectively corresponding to the two relief holes 611. Furthermore, switching member 62 can include two sealing portions 622 respectively corresponding to the two relief holes 611.

When switching member 62 is in the first position, high pressure indicator 623 is exposed, and air guiding grooves 621 intercommunicate with relief holes 611, such that second chamber 23 intercommunicates with the outside. Thus, when second cylinder 20 moves relative to first cylinder 10 along the longitudinal axis, the air in second chamber 23 is pushed by second piston 42 to flow to the outside via relief holes 611 and air guiding grooves 621. Namely, work is not done on the air in second chamber 23 by second piston 42, but first piston 41 compresses the air in first chamber 13 to proceed with high pressure inflation.

When the switching member 62 is in the second position, high volume indicator 624 is exposed, and sealing portions 622 seal relief holes 611, such that second chamber 23 is isolated from the outside. Thus, when second cylinder 20 moves relative to first cylinder 10 along the longitudinal axis, the air in first chamber 13 and the air in second chamber 23 are respectively compressed by first piston 41 and second piston 42 to proceed with high volume inflation.

Handle 70 is pivotably mounted to connecting member 61 by a pin 71. Handle 70, first cylinder 10, and second cylinder 20 are arranged in a substantially T-shaped manner to permit the user to proceed with inflation. Check valve device 80 includes a first check valve 81 and a second check valve 82. First check valve 81 is mounted to mounting portion 34 of air tube 30. Second check valve 82 is mounted to second piston 42. First check valve 81 includes a first check member 811 mounted in first annular groove 341, a first airtight ring 812 mounted in second annular groove 342, and a second airtight ring 813 mounted in third annular groove 343. First check member 811 is made of a soft material and is annular. Furthermore, first check member 811 has increasing outer diameter towards head 51 along the longitudinal axis. Thus, compressed air is permitted to flow from first chamber 13 through air passage 33 into head 51 in a single direction. First airtight ring 812 provides an airtight effect between air passage 33 and first chamber 13. Second airtight ring 813 provides an airtight effect between air passage 33 and head 51. Second check valve 82 includes a second check member 821 and a third airtight ring 822. Second check member 821 is movably received in through-hole 421 to permit compressed air in second chamber 23 to flow into air passage 33 in a single direction. In this embodiment, second check member 821 is in the form of a ball. Third airtight ring 822 is mounted on an outer periphery of second piston 42 to provide an airtight effect between second piston 42 and second chamber 23.

In view of the foregoing, by integrally forming mounting portion 34 on first end 31 of air tube 30, in assembly of the variable pressure air pump according to the present invention, first check valve 811, first airtight ring 812, and second airtight ring 813 of first check valve 81 can be mounted into first annular groove 341, second annular groove 342, and third annular groove 343 of mounting portion 34 in sequence. Head 51 is assembled to first end 11 of first cylinder 10. Air tube 30 is mounted in first cylinder 10. Second cylinder 20 is mounted around air tube 30. Connecting member 61 is connected to second end 22 of second cylinder 20. Thus, most of the assembling procedures of the air pump can be completed, achieving rapid assembly.

Although specific embodiments have been illustrated and described, numerous modifications and variations are still possible without departing from the scope of the invention. The scope of the invention is limited by the accompanying claims.

The invention claimed is:

1. A variable pressure air pump comprising:

a first cylinder including a first chamber;

a second cylinder including a second chamber selectively intercommunicating with an outside, wherein the second cylinder and the first cylinder are coaxially mounted about a longitudinal axis, and wherein the second cylinder is movable relative to the first cylinder along the longitudinal axis;

an air tube mounted in the first chamber and the second chamber, wherein the air tube includes a first end, a second end opposite to the first end, an air passage intercommunicating the first chamber with the second chamber in a single direction, and a mounting portion integrally formed on the first end of the air tube;

a first piston mounted on a first end of the second cylinder and configured to compress air in the first chamber;

a second piston mounted to the second end of the air tube and configured to selectively compress air in the second chamber;

a connecting device mounted to a first end of the first cylinder and configured to couple with an object to be inflated;

an air escape device mounted to a second end of the second cylinder, wherein the air escape device selectively seals the second chamber to control intercommunication between the second chamber and the outside;

a first check valve mounted to the mounting portion of the air tube and configured to permit compressed air in the first chamber to flow through the air passage and the connecting device and into the object to be inflated in a single direction; and a second check valve mounted to the second piston and configured to permit compressed air in the second chamber to flow into the air passage in a single direction, wherein the mounting portion includes a first annular groove, a second annular groove, and a third annular groove, wherein the first, second, and third annular grooves are defined in a circumferential direction of the mounting portion and are parallel to each other, wherein the first check valve includes a first check member mounted in the first annular groove, a first airtight ring mounted in the second annular groove, and a second airtight ring mounted in the third annular groove.

2. The variable pressure air pump as claimed in claim 1, wherein the first check member is annular, and wherein the first check member has increasing outer diameter towards the connecting device along the longitudinal axis.

3. The variable pressure air pump as claimed in claim 1, wherein the second piston includes a through-hole extending between the second chamber and the air passage, wherein the second check valve includes a second check member movably received in the through-hole and a third airtight ring mounted on an outer periphery of the second piston.

4. The variable pressure air pump as claimed in claim 3, wherein the second check member is in a form of a ball.

5. The variable pressure air pump as claimed in claim 1, wherein the connecting device includes a head and a valve unit mounted in the head, wherein the head is connected to the first end of the first cylinder, and wherein the valve unit intercommunicates with the air passage.

6. The variable pressure air pump as claimed in claim 1, wherein the first cylinder includes a cap having an air replenishment hole intercommunicating with the first chamber.

7. A variable pressure air pump comprising:

a first cylinder including a first chamber;

a second cylinder including a second chamber selectively intercommunicating with an outside, wherein the second cylinder and the first cylinder are coaxially mounted about a longitudinal axis, and wherein the second cylinder is movable relative to the first cylinder along the longitudinal axis;

an air tube mounted in the first chamber and the second chamber, wherein the air tube includes a first end, a second end opposite to the first end, an air passage intercommunicating the first chamber with the second chamber in a single direction, and a mounting portion integrally formed on the first end of the air tube;

a first piston mounted on a first end of the second cylinder and configured to compress air in the first chamber;

a second piston mounted to the second end of the air tube and configured to selectively compress air in the second chamber;

a connecting device mounted to a first end of the first cylinder and configured to couple with an object to be inflated;

an air escape device mounted to a second end of the second cylinder, wherein the air escape device selectively seals the second chamber to control intercommunication between the second chamber and the outside;

a first check valve mounted to the mounting portion of the air tube and configured to permit compressed air in the first chamber to flow through the air passage and the connecting device and into the object to be inflated in a single direction; and a second check valve mounted to the second piston and configured to permit compressed air in the second chamber to flow into the air passage in a single direction, wherein the air escape device includes a connecting member and a switching member, wherein the connecting member is connected to the second cylinder and includes at least one relief hole intercommunicating with the second chamber, wherein the switching member is connected to the connecting member and is switchable between a first position and a second position, wherein the switching member includes at least one air guiding groove selectively intercommunicating the at least one relief hole and the outside, wherein the switching member further includes at least one sealing portion selectively seals the at least one relief hole, wherein when the switching member is in the first position, the at least one air guiding groove intercommunicates with the at least one relief hole, and the second chamber intercommunicates with the outside, and wherein when the switching member is in the second position, the at least one sealing portion seals the at least one relief hole, and the second chamber is isolated from the outside.

8. The variable pressure air pump as claimed in claim 7, wherein the switching member is annular and rotatably mounted around the connecting member, wherein the at least one guiding groove and the at least one sealing portion are disposed on an inner periphery of the switching member, wherein at least one high pressure indicator is disposed on an outer periphery of the switching member and is located corresponding to the at least one air guiding groove, and wherein at least one high volume indicator is disposed on the outer periphery of the switching member and is located corresponding to the at least one sealing portion.

9. The variable pressure air pump as claimed in claim 7, further comprising a handle pivotably mounted to the connecting member by a pin.

* * * * *